US005114252A

United States Patent [19]

Tanuma et al.

[11] Patent Number: 5,114,252

[45] Date of Patent: May 19, 1992

[54] PRINTER WITH PROTECTION FROM DISCHARGE LINE DISCONNECTION

[75] Inventors: Jiro Tanuma; Shinichi Katakura, both of Tokyo, Japan

[73] Assignee: Oki Electric Industry Co., Ltd., Tokyo, Japan

[21] Appl. No.: 592,292

[22] Filed: Oct. 3, 1990

[30] Foreign Application Priority Data

Oct. 13, 1989 [JP] Japan ..... 1-266866

[51] Int. Cl.[5] ..... B41J 2/30

[52] U.S. Cl. ..... 400/124; 400/54

[58] Field of Search ..... 400/54, 74, 124 TC, 400/157.2

[56] References Cited

U.S. PATENT DOCUMENTS

| | | | |
|---|---|---|---|
| 4,411,540 | 10/1983 | Nozaki | 400/54 |
| 4,540,295 | 9/1985 | Okunishi | 400/124 TC |
| 4,553,867 | 11/1985 | Nakai | 400/54 |
| 4,705,412 | 11/1987 | Matsumoto | 400/54 |
| 4,978,239 | 12/1990 | Alexander | 400/54 |

FOREIGN PATENT DOCUMENTS

| | | | |
|---|---|---|---|
| 15168 | 1/1985 | Japan | 400/124 TC |
| 143152 | 6/1986 | Japan | 400/74 |
| 167594 | 7/1986 | Japan | 400/74 |
| 248772 | 11/1986 | Japan | 400/74 |
| 152887 | 7/1987 | Japan | 400/74 |
| 286757 | 12/1987 | Japan | 400/124 TC |

*Primary Examiner*—David A. Wiecking
*Assistant Examiner*—Steven S. Kelley
*Attorney, Agent, or Firm*—Spencer, Frank & Schneider

[57] ABSTRACT

In a printer that includes a carriage section having a print head with a plurality of drive coils provided therein, and a control unit having a power supply circuit supplies drive power to the print head, and a cable having conductors for connecting the control unit and the carriage section, a drive power supply node and discharge node in the carriage section are connected to an output terminal of the power supply circuit in the control unit via the cable. Drive power for the plurality of drive coils is supplied from the terminal of the power supply circuit through the cable and the drive power node, and magnetic energy accumulated in the drive coils is discharged through the discharge node and through the cable to the output terminal of the power supply circuit. Printer protection is achieved by detecting, in the carriage section, whether the discharge node is satisfactorily connected with the terminal of the power supply circuit. This is determined in accordance with the magnitude of the voltage applied to the discharge line. The printing operation is prevented if an unsatisfactory connection is detected.

18 Claims, 4 Drawing Sheets

PRINTER WITH PROTECTION FROM DISCHARGE LINE DISCONNECTION

BACKGROUND OF THE INVENTION

This invention relates to a printer in which magnetic energy accumulated in a drive coil in a carriage section is released to a control unit, and more particularly to protection for such a printer from overheating and damage to the components due to disconnection of a discharge line in the carriage section from the control unit.

A serial printer is known in which a carriage section moving in the direction of printing (direction of spacing), and a control unit for controlling the printing operation of the carriage section are in the form of units separate from each other and these are connected together by a cable. In such a serial printer, a power supply circuit for supplying drive power to a print head mounted on the carriage section is disposed in the control unit, and the power is supplied through the cable to the carriage.

FIG. 4 shows part of the prior art printer driver, including the power supply nodes or lines. Connected to the positive electrode Vp of the driver power supply circuit 7 disposed in the control unit 1 are a drive power supply line 38*a* and a discharge line 37*a*. Connected to the negative electrode Ep is a ground line 39*a*. The lines 37*a*, 38*a* and 39*a* are connected to respective terminals in an output port, and via a cable 3 to a discharge line 37*b*, a drive power supply line 38*b* and a ground line 39*b* disposed in a metal carriage section 4. Moreover, a switching element 16, formed for example of a transistor, is interposed in the drive power supply 38*a*, and the drive power supply line 38*a* and the ground line 39*a* are shunted via a series connection of diodes 17*a*, 17*b* and 17*c*.

In the metal carriage section 4, dot wire drive coils 15*a*, 15*b*, etc. are provided in the print head 6. One end of each of the coils 15*a*, 15*b*, etc. is connected to the drive power supply line 38*b*, while the other end is connected to the ground line 39*b* via switching elements in a switching circuit 12. Accordingly, formed between the drive power supply circuit 7 and the coils 15*a*, 15*b*, etc. is a drive power supply path comprising the switching element 16, the drive power lines 38*a*, 38*b*, the cable 3, the switching circuit 12, and the ground lines 39*a*, 39*b*. Drive power is supplied to the coils that are selected in accordance with the print data. For instance, when the coil 15*a* is selected, a drive current $I_A$ flows through the coil 15*a* as shown in the equivalent circuit of FIG. 5A. This current flows through the drive power supply 7 in the forward direction. Because of this current, the dot wire (not shown) in the print head is driven forward toward the print medium on a platen (not shown), and printing is performed.

Thus, when the drive current $I_A$ flows, magnetic energy is accumulated in the coil 15*a*. When the switching element 16 is opened and the current path from the power supply circuit 7 is interrupted, the accumulated energy acts to maintain the current $I_B$ through the coil 15*a*. This current flows through a closed path including the coil 15*a*, the switching element 12, and the diodes 17*c*, 17*b* and 17*a*. The coil 15*a* thereby maintains the electromagnetic force. The dot wire is kept in the projecting state for the period while the current $I_B$ flows.

When the switch 12 is opened, as shown in FIG. 5C, an energy discharge current $I_C$ flows through the path including the diodes 17*c*, 17*b* and 17*a*, the coil 15*a*, and the diode 13*a*. This current flows through the drive power supply 7 in the reverse direction. In other words, this current is a regenerative current due to an electromotive force induced in the coil 15*a* attempting to maintain the current in the same direction (when it passes through the coil) as before the current path is changed. The coil 15*a* thereby loses the electromagnetic force and the dot wire of the print head returns to the original position, and is ready for next printing stroke. The current which flows through the coil assumes a waveform as shown by solid line A in FIG. 6.

When the control unit 1 and the metal carriage section 4 are connected together by a cable 3 as described above, it many happen that the joint, such as a connector, between the cable 3 and the control unit 1, or the joint, such as a connector, between the cable 3 and the metal carriage section 4 has an unsatisfactory connection. The unsatisfactory connection may be either a total disconnection or a poor connection. When the connection is unsatisfactory, the printer may operate erroneously or may break down. To prevent this, a limit switch may be provided to supervise the insertion of the connector and hence the connection. The limit switch and outputs a signal to inhibit the printing operation when the connection is improper. With the conventional detecting device, however, it was not possible to detect unsatisfactory connection of individual conductors in the cable 3. When, therefore, a certain conductor was broken or poorly connected, this was not detected and the connection waws considered proper as long as the insertion of the connector was proper.

If any of the conductors forming the drive power supply lines 38*a* and 38*b*, and ground lines 39*a* and 39*b* is broken or poorly connected, power is not supplied to the print head 6, and the printing is not initiated. If a logic power supply line, data signal line, enable signal line or the like is broken or poorly connected, the printing is disabled, and the printing is not started. The user or the operator of the printer is therefore immediately informed of the abnormality without damage (degradation or breakdown) to the circuit components.

However if the discharge line 37*a* or 37*b* is broken or poorly connected, printing is not disabled, and there appears to be no abnormality. The operator will not notice the broken or poorly connected line. However, in such a case, as shown by the dotted line in FIG. 6, the energy accumulated in the coils 15*a* or 15*b* is not fully discharged before the next cycle of operation. The impedance of the coil is therefore effectively reduced, and the coil current in the next cycle is increased, and the heat generation in the metal carriage section 4 is increased. This may cause degradation or breakdown of circuit components.

Moreover, because the drop in the coil current is not sharp, the return of the dot wire is not swift, and the printing quality is degraded.

SUMMARY OF THE INVENTION

An object of the invention is to prevent damage to the circuit components in the event of disconnection or poor connection of a discharge line for discharging the magnetic energy accumulated in a dot wire drive coil.

Another object of the invention is to improve the printing quality in the event of disconnection or poor connection of the discharge line.

A printer according to the invention comprises a carriage section having a print head with a plurality of drive coils provided therein, and a control unit having a power supply circuit and supplying drive power to the print head, and a cable comprising conductors for connecting the control unit and the carriage section. A drive power supply node and discharge node in the carriage section are connected to an output terminal of the power supply circuit in the control unit via the cable. Drive power for the plurality of drive coils is supplied from the terminal of the power supply circuit through cable and the drive power node, and magnetic energy accumulated in the drive coils is discharged through the discharge node and through the cable to the output terminal of the power supply circuit. Printer protection is achieved by detecting, in the carriage section, unsatisfactory connection of the discharge node with the terminal of the power supply circuit in accordance with the magnitude of the voltage applied to the discharge line, and the printing operation is inhibited if an unsatisfactory connection is detected.

DETAILED DESCRIPTION OF THE EMBODIMENTS

Figure 1:
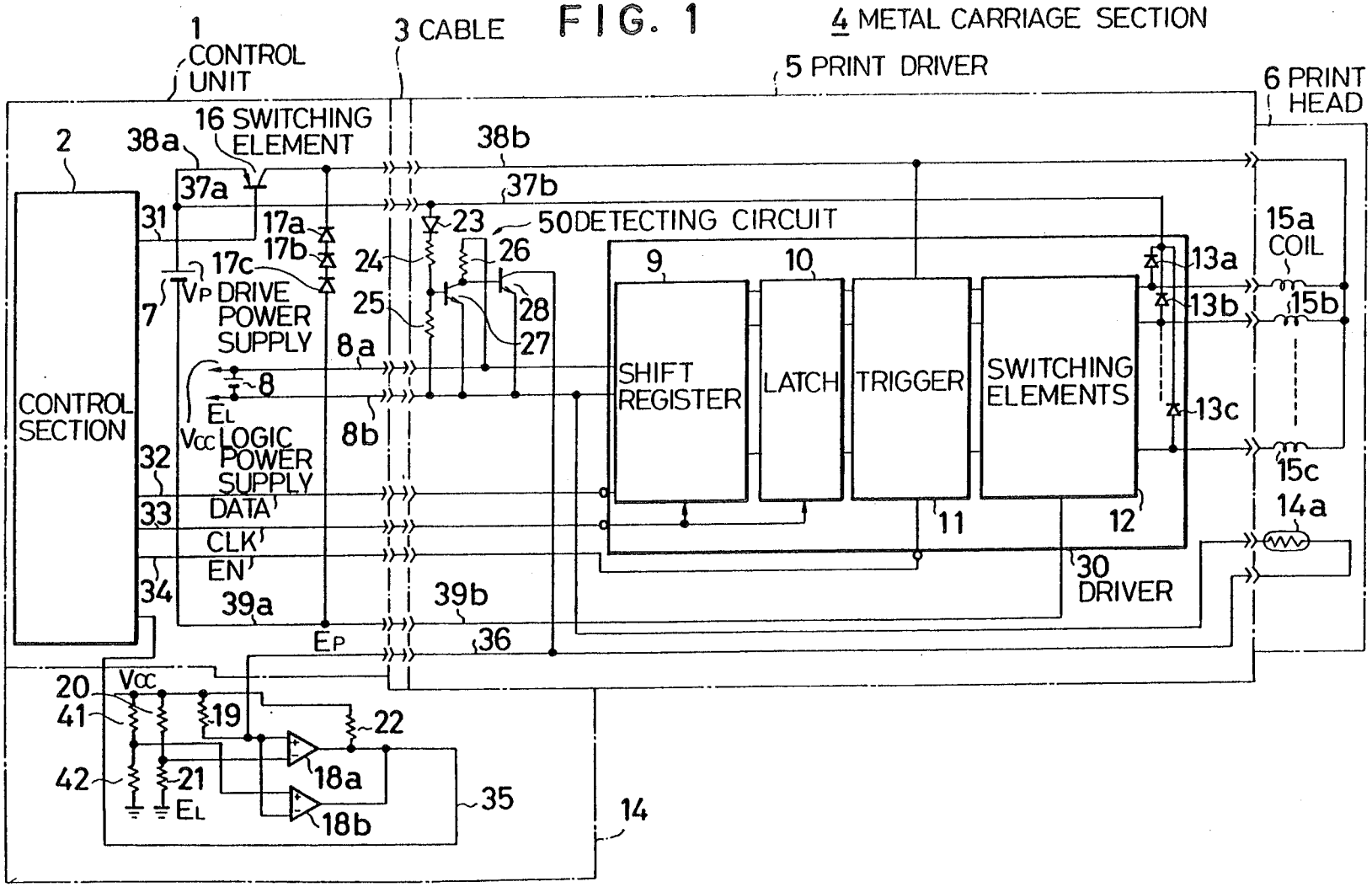
FIG. 1 is a diagram showing part of the circuit of the printer drive section according an embodiment of the invention.

FIG. 1 shows a serial printer having a protection circuit according to an embodiment of the invention.

As illustrated, the serial printer comprises a control unit 1 for controlling the printing operation of the serial printer of the embodiment, a metal carriage section 4, in a unit separate from the control unit 1, and moving in the direction of printing (direction of spacing) to print on a medium passing over a platen, and a cable 3 for connecting together the control unit 1 and the metal carriage section 4.

The control unit 1 is provided with a control section 2, and a temperature detecting circuit 14, as well as a drive power supply circuit 7 and a logic power supply circuit 8. The power consumed in the metal carriage section 4 is fed from the control unit 1 through the drive power supply lines 38*a*, 38*b*, the ground lines 39*a*, 39*b*, and the logic power supply lines 8*a*, 8*b*.

The metal carriage section 4 is formed of a print control/drive section 5 and the print head 6, and the driver 30 for driving the print head 6 is disposed in the print control section 5. The driver 30 comprises a serial-parallel converter 9 consisting of a shift register, a latch circuit 10, a trigger circuit 11 and a switch circuit 12, and performs control over printing of the print head 6 in accordance with print data DATA, a clock signal CLK, and an enable signal EN which are supplied from the control unit 2 through a data signal line 32, a clock signal line 33 and an enable signal line 34.

The temperature of the print head 6 is detected by a temperature sensor, such as a thermistor 14*a*, and supplied through a temperature signal line 36 to the temperature detecting circuit 14.

The temperature detecting circuit 14 comprises first and second comparators 18*a*, 18*b*, and resistors 19 to 22, 41, and 42. The resistors 20 and 21 are connected in series between the logic power supply Vcc (e.g., 5V) and the ground EL to form a first voltage divider providing a first reference voltage of 2.5 V for example, which is applied to the inverted input terminal (−) of the first comparator 18*a*. The resistors 41 and 42 are connected in series between the logic power supply Vcc and the ground EL to form a second voltage divider providing a second reference voltage of a second level, 4.5 V for example, which is intermediate between the first voltage reference (2.5 V) and the logic power supply voltage (5 V). The second reference voltage is applied to the noninverted input terminal (+) of the second comparator 18*b*. The noninverted input terminal (+) of the first comparator 18*a* and the inverted input terminal (−) of the second comparator 18*b* are connected to the temperature signal line 36 and also through the resistor 19 to the logic power supply Vcc. The outputs of the comparators 18*a* and 18*b* are connected together, and they are connected through the resistor 22 to the logic power supply Vcc and connected via a signal line 35 to the control section 2. This connection of the outputs of the comparators 18*a* and 18*b* through the resistor 22 to the power supply voltage Vcc serves as an AND gate means.

Each of the comparators 18*a* and 18*b* produces a high level output when its input at the noninverted input terminal (+) is higher than its input at the inverted input terminal (−), and produces a low level output when its input at the noninverted input terminal (+) is lower than its input at the inverted input terminal (−). When at least one of the comparators 18*a* and 18*b* produces a low level output the signal on the line 35 is at a low level.

When the temperature of the print head is lower than the preset temperature, and the discharge line 37*b* and the temperature signal line 36 are properly connected, the voltage on the temperature signal line 36 is between the first and the second reference voltages (2.5 V and 4.5 V) and the first and the second comparators produce high level signals, so that the signal on the line 35 is at a high level. When the temperature of the print head 6 is higher than the preset temperature, the potential on the temperature signal line 36 is at a level lower than the first reference voltage (2.5 V). So the first comparator 18*a* produces a low level output, and the signal on the line 35 is at a low level.

When the temperature signal line 36 is disconnected, the voltage applied to the inverted input terminal (−) of the second comparator 18*b* is at about Vcc (=5 V), which is higher than the second reference voltage (4.5 V) applied to the noninverted terminal, and the comparator 18*b* produces a low level signal, so the signal on the line 35 is at a low level.

When the discharge line 37*b* is disconnected, the termperature signal line 36 is lowered to a low level, by virtue of an unsatisfactory connection detecting circuit 50, which will be described next.

The unsatisfactory connection detecting circuit 50 detects the magnitude of the voltage applied to the discharge line 37*b*. It is provided in the metal carriage section 4. In the embodiment, a series circuit comprising a diode 23, and a voltage divider formed of resistors 24 and 25 is connected across the discharge line 37*b* and the power supply line 8*b* connected to the negative electrode EL of the logic power supply circuit 8. A and a voltage derived from the output of the voltage divider, i.e., the junction between the resistors 24 and 25, is applied to the base of a voltage detecting transistor 27.

The voltage detecting transistor 27 is of the NPN type. Its emitter is connected to the logic power supply line 8*b*, and its collector is connected through a resistor 26 to the power supply line 8*a* connected to the positive electrode Vcc of the logic power supply circuit 8. When there is no disconnection or poor connection and a positive voltage Vp from the drive power supply circuit 7 is applied to the discharge line 37*b*, the voltage detecting transistor 27 is ON, and its collector potential is at a low level (Low). When the positive voltage Vp is not applied to the discharge line 37*b* due for example to disconnection, the voltage detecting transistor 27 is OFF and its collector is at a high level.

The collector potential of the voltage detecting transistor 27 is applied to the base of a control transistor 28. The control transistor 28 is also of the NPN type, and its emitter is connected to the logic power supply line 8*b* while its collector is connected to the temperature signal line 36. When the control transistor 28 is turned ON, the potential on the temperature signal line 36 is brought to a low level.

Figure 2:
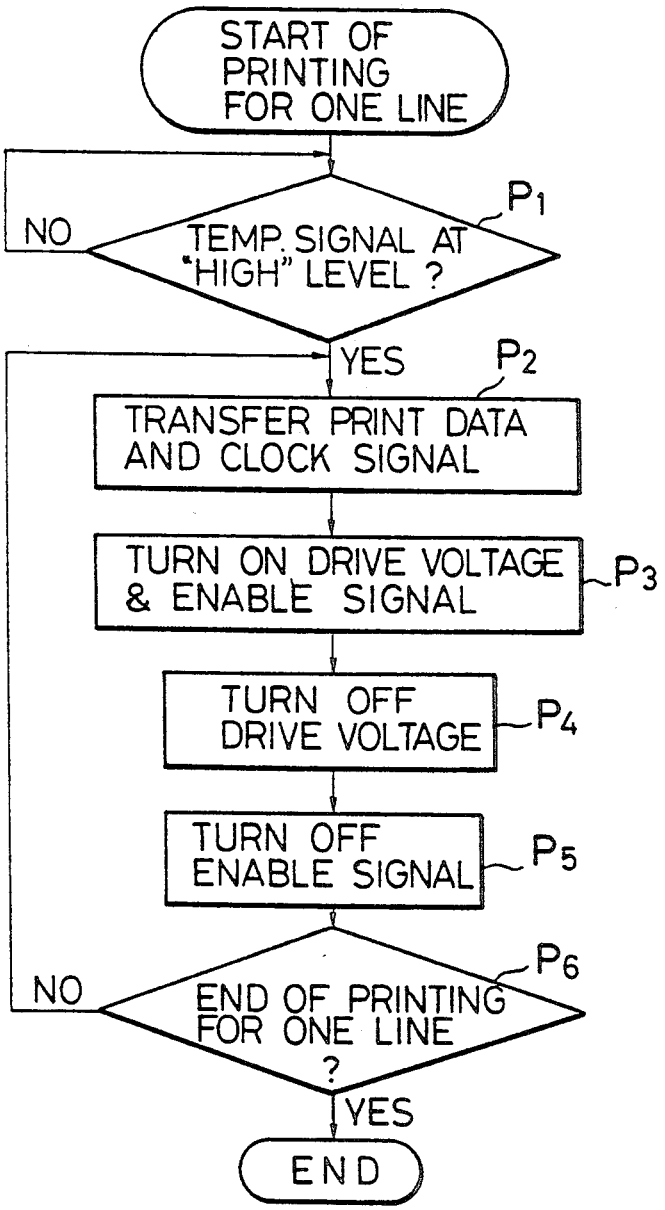
FIG. 2 is a flowchart for explaining the printing operation.
Figure 3:
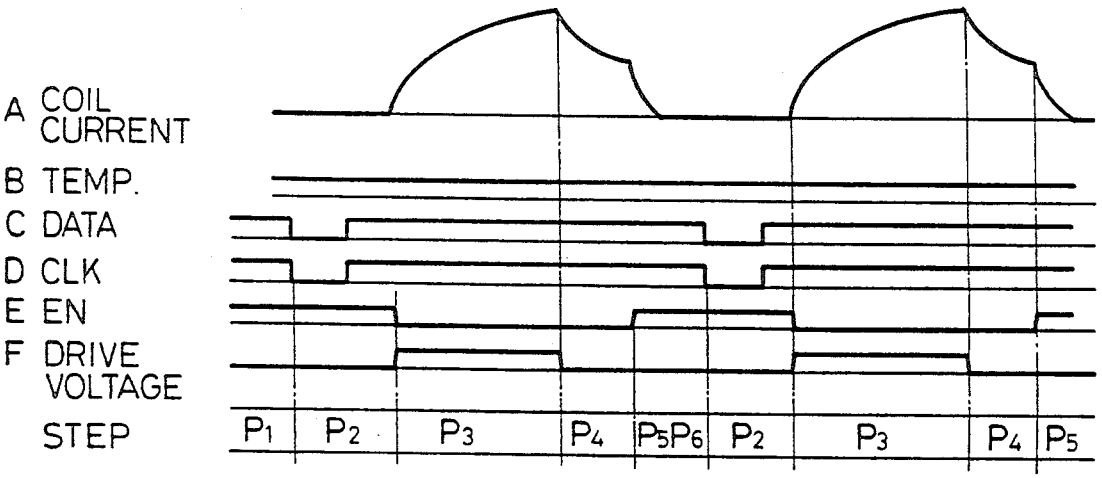
FIG. 3 is a diagram showing waveforms at various nodes in the circuit of FIG. 1.
Figure 4:
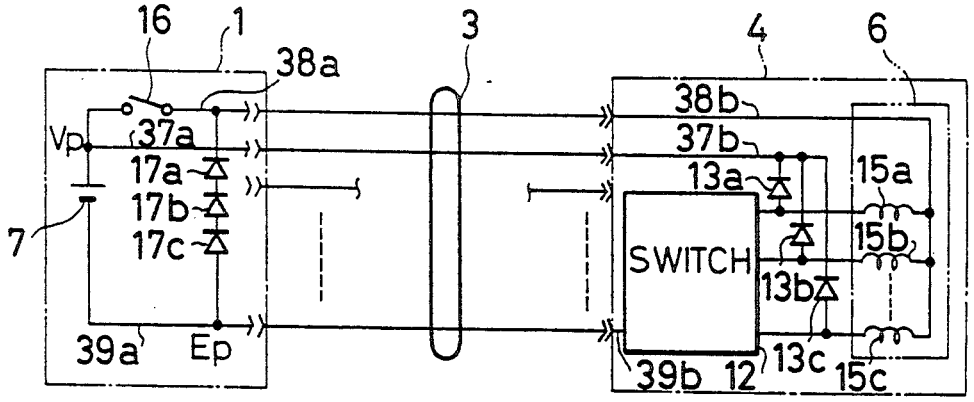
FIG. 4 PRIOR ART
FIG. 4 is a diagram showing the circuit of a printer drive section in the prior art.
Figures 5A, 5B, 5C:
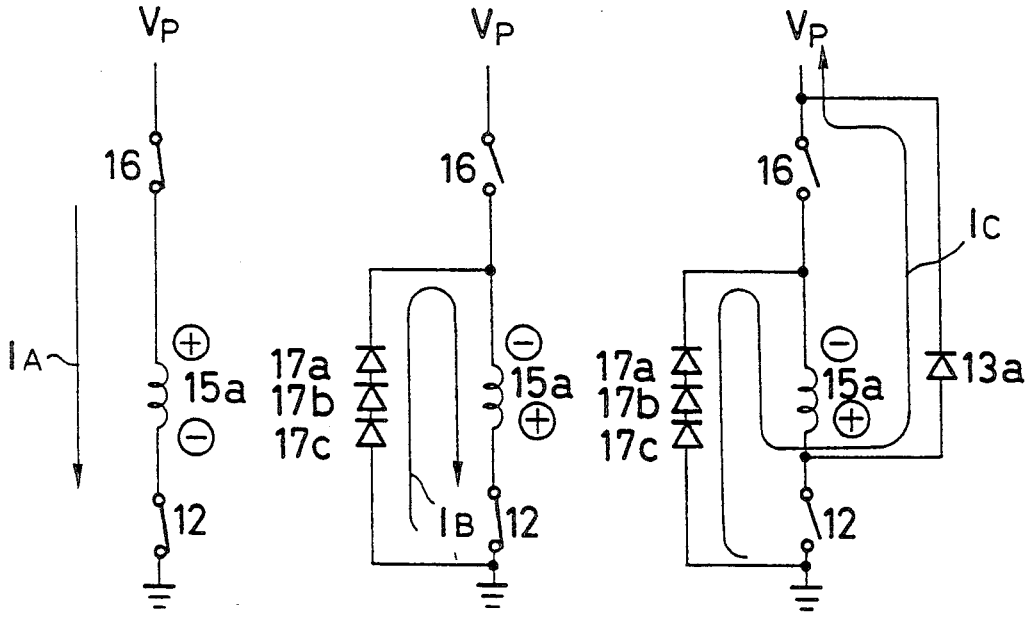
FIG. 5A, FIG. 5B and FIG. 5C are equivalent circuit diagrams showing equivalent circuits for the coils, and are employed for explaining the current flowing through a coil.
Figure 6:
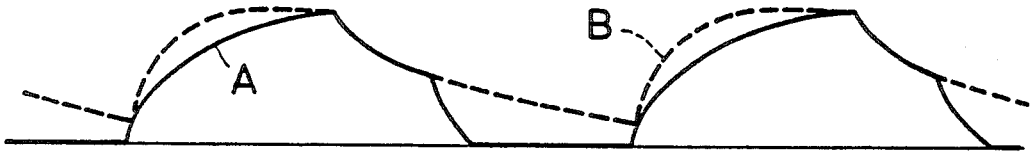
FIG. 6 is a diagram showing the waveforms of current through a coil.

Now the flowchart of FIG. 2 and the waveform diagram of FIG. 3 will be used for the description of the printing operation. When it is desired to start the printing for one line, prior to actual printing, at step P1, a decision is made whether or not the temperature signal that is being output from the temperature detecting circuit 14 on the line 35 is high. If the potential on the temperature signal line 36 is not high, it is recognized that the temperature of the print head is higher than a reference value, and the start of the actual printing is inhibited.

When, as shown in FIG. 3B, the potential on the temperature signal line 36 is at a high level, the step P2 is performed wherein print data are serially transferred from the control unit 2 to the driver 30. As shown in FIG. 3C and FIG. 3D, the transfer of the print data is performed while the clock signals are produced. The print data that have been transferred during a clock signal are stored in a shift register 9, and when the clock signal ends, the print data are transmitted in parallel from the shift register 9 to a latch circuit 10. In this way, serial-to-parallel conversion is achieved, and the parallel data of, say 24 bits for 24 dot wires, are held in the latch circuit 10.

At step P3, a signal is given from the control unit 2 via the signal line 31 to turn ON the switching transistor 16. The transistor 16 is thereby turned ON, and as shown in FIG. 3F, it is now possible to supply the drive voltage to each coil 15*a*, 15*b*, and so on. At step P3, the enable signal EN is turned ON as shown in FIG. 3E, and drive currents are made to flow through the coils selected by the print data, as shown in FIG. 3A. Because of the electromagnetic forces generated thereby, dot wires are projected and press the ink ribbon against the print medium.

At step P4, the switching transistor 16 is turned OFF, and the drive power ceases to be supplied to the coils, but due to the electromotive force induced in the coils (which tends to maintain the current), the currents continue to flow through the path for holding the magnetic energy as described above, and the electromagnetic force is thereby maintained.

At step P5, the enable signal EN is turned OFF, and the switching circuit 12 is opened. Because of the electromotive force induced in the coils, the currents then begin to flow through the diodes 17*a*, 17*b* and 17*c*, the coils (15*a* and the like), and the diodes (13*a* and the like). The magnetic energy that has been accumulated in the coils is discharged and the dot wires of the print head 6 are returned to the original position.

At step P6, a decision is made whether printing of one line is completed. If it is not completed, the steps P2 to P5 are repeated.

The temperature signal from the temperature detecting circuit 14 is also at a low level when a disconnection or poor connection occurs to the discharge line 37*b*. Assume that the plug of the connector for the discharge line 37*b* is unsatisfactory. In this case, the positive voltage Vp of the drive power supply circuit 7 is not applied to the discharge line 37*b*, and the voltage detecting transistor 27 is therefore turned OFF. Accordingly, the control transistor 28 is turned ON, and the potential on the temperature signal line 36 is lowered to the ground level. The result is similar to the situation in which the resistance of the thermistor 14*a* is reduced due to an increase of the temperature in the print head 6. The temperature signal on the line 35 supplied from the temperature detecting circuit 14 to the control circuit 2 is therefore at a low level. Thus, when the discharge line is in the state of unsatisfactory connection, there is no transition from the step P1 to the step P2, and the printing operation is not started.

In the present embodiment, if the connection of the discharge line becomes unsatisfactory in the middle of printing for one line, the printing is continued until the end of that line. Even in the state in which the accumulated energy is discharged poorly, this is not problematical since the heat generated from the driver 30 during printing of one line (even with the unsatisfactory connection of the discharge line) is tolerable. However, it is also possible to arrange the system such that when an unsatisfactory connection of the discharge line is detected by the voltage detecting transistor 27, the printing is promptly interrupted.

Moreover, it is also possible to inhibit the start of the printing by preventing closure of the switching elements of the switching circuit 12 by use of an output of the voltage detecting circuit 50.

The invention has been described in connection with a serial printer. But the invention is applicable to any other printers which discharge magnetic energy accumulated in the drive coil in the carriage section and supply the discharged energy to the control unit. For instance, the invention is applicable to parallel dot printers.

As has been described, when the discharge line for discharging the magnetic energy is disconnected or poorly connected, the start of printing is inhibited. Accordingly, printing is inhibited when the magnetic energy accumulated in the drive coil is not fully discharged, and temperature rise for that reason is avoided, and degradation and breakdown of the circuit components are suppressed, and the lifetime of the printer is lengthened.

Moreover, by inhibiting the start of printing when the printer is in the state in which the energy accumulated in the coil is not fully discharged, the occurrence of the abnormality is made known to the operator. Continued use of the printer with its printing quality lowered or with the danger of the breakdown of the circuit components is therefore avoided.

What is claimed is:

1. A printer comprising:

a carriage section having a print head which is mounted therein and which has a plurality of drive coils provided therein;

a control unit having a power supply circuit mounted therein and supplying drive power to said print head;

a cable comprising a plurality of conductors for connecting said control unit and said carriage section;

a drive power supply node and a discharge node in said carriage section being connected to an output terminal of said power supply circuit in said control unit via a drive power supply conductor and a discharge conductor forming part of said cable;

drive power for said plurality of drive coils being supplied from said terminal of said power supply circuit through said drive power supply node;

magnetic energy accumulated in said drive coils being discharged through said discharge node to said output terminal of said power supply circuit;

a printer protection circuit means provided in said carriage section for detecting an unsatisfactory connection of said discharge node with said terminal of said power supply circuit in accordance with the magnitude of the voltage applied to said discharge conductor, and for preventing the printing operation when it detects an unsatisfactory connection;

a temperature sensor for detecting the temperature of the print head and producing a signal which is in a certain region when the temperature is higher than a predetermined value;

a means for inhibiting the printing operation when the signal output from said temperature sensor is within said certain region;

said printer protection circuit means comprising means for bringing the output of the temperature sensor into said certain region;

said control unit further comprising an additional power supply node connected to said cable, and having a predetermined potential difference from the discharge node when the connection is satisfactory;

wherein said printer protection circuit means comprises means for monitoring the potential difference between said discharge node and said additional power supply node;

wherein said potential difference monitoring means comprises a voltage divider connected across the discharge node and said additional power supply node, and a transistor turned on or off depending on the potential on the output of the voltage divider; and wherein said additional power supply node is one of a pair of logic power supply nodes connected to said cable, and said transistor is connected through a resistor across said pair of logic power supply nodes, and said potential difference monitoring means further comprises an additional transistor tuned on or off depending on the on/off operation of the first-mentioned transistor, and connected across the output of the temperature sensor and said additional power supply node.

2. A printer according to claim 1, wherein said temperature sensor comprises a thermistor.

3. A printer according to claim 1, wherein said inhibiting means comprises a temperature detecting circuit and is provided in said control unit, and said temperature sensor is provided in said carriage section and is connected to said temperature detecting circuit through a temperature signal conductor forming part of said cable.

4. A printer according to claim 3, wherein said control unit comprises a control section for producing a print enable signal, which is transmitted to said carriage section via an enable control conductor forming part of said cable; and said temperature detecting circuit is connected to said control section to prevent the production of said enable signal when the output of the temperature sensor is in said certian region.

5. A printer according to claim 4, wherein said temperature detecting circuit comprises:

a first comparator having a first input terminal connected to said temperature signal conductor and through a registor to a node of a predetermined voltage and having a second input terminal connected to receive a first reference voltage, and producing a high level signal when the voltage level at said first input terminal is higher than the voltage level at said second input terminal;

a second comparator having a first input terminal connected to receive a second reference voltage, and having a second input terminal connected to said temperature signal conductor and through said resistor to said node of said predetermined voltage, and producing a high level signal when the voltage level at said first input terminal is higher than the voltage level at said second input terminal;

said second reference voltage being between said first reference voltage and said predetermined voltage;

the output of said temperature sensor producing a signal at a level between said first and second reference voltages when the temperature is lower than the predetermined temperature, and is lower than said first reference voltage when the temperature is higher than said predetermined temperature;

an AND means for receiving the outputs of said first and second comparators and producing a low level signal when at least one of said first and second comparators outputs a low level signal; and the output of said AND means constituting the output of said temperature detecting circuit and being supplied to said control section.

6. A printer according to claim 1, wherein said cable is connected to the carriage section by a connector.

7. A printer according to claim 1, wherein said cable is connected to the control unit by a connector.

8. A printer according to claim 1, wherein said carriage section comprises means, controlled by said control section, for forming a current path to cause a current to flow through said drive power supply circuit, in the forward direction, through said drive power supply conductor and through a drive coil when the drive current is to be initiated, and for forming a current path to permit a current to flow through the respective drive coil, through the discharge conductor and through the drive power supply circuit in the reverse direction, when the drive current is to be terminated.

9. A printer according to claim 3, wherein said certain region is less than about 2½ volts.

10. A printer, comprising:

a control unit which includes a drive power supply circuit with a drive power supply terminal, a switching element connected to the drive power supply terminal, and a logic power supply circuit with first and secnd logic power supply terminals;

a carriage section which includes a temperature sensor and a print head with a plurality of drive coils, the carriage section additionally including a drive power supply node, a discharge node, first and second logic power supply nodes, and a sensor node, the temperature sensor producing a signalk at the sensor node which has a voltage within a certain region when the temperature is higher than a predetermined value;

a cable between the control unit and the carriage section, the cable includes a drive power supply conductor to convey energy for the drive coils from the drive power supply terminal via the switching element to the drive power supply node, a discharge conductor to convey energy discharged by the drive coils due to magnetic energy accumulated therein from the discharged node to the drive power supply terminal, a the logic power supply conductor connecting the first logic power supply terminal to the first logic power supply node, and a second logic power supply conductor connecting the second logic power supply terminal to the second logic power supply node;

inhibiting means for inhibiting the printing operation of the printer if the voltag at the sensor node is within the certain region; and printer protection circuit means for bringing the voltage at the sensor node within the certain region if the discharge node is not adequately connected to the drive power supply terminal by the discharge conductor, the printer protection circuit means being provided in the carriage section and including a voltage divider connected between the discharge node and the first logic power supply node, the voltage divider having a voltage divider output, and switching means, including a further switching element connected between the sensor node and one of the logic power supply nodes, for turning the further switching element on or off depending on the voltage divider output.

11. The printer of claim 10, wherein the further switching element is a first transistor that is connected between the first logic power supply node and the sensor node, the first transistor having a control electrode, and wherein the switching means further comprises a resistor, a second transistor that is connected through the resistor across the first and second logic supply nodes, the second transistor haivng a control electrode that receives the voltage divider output and the resistor being connected to the control electrode of the first transistor.

12. The printer of claim 10, wherein the inhibiting means is provided at the control unit, and wherein the cable further includes an additional conductor connecting the sensor node to the inhibiting means.

13. The printer of claim 12, wherein the inhibiting means comprises:

a resistor;

a first comparator having a first input terminal connected to the additional conductor and through the resistor to one of the logic power supply nodes, and having a second input terminal connected to receive a first reference voltage, the first comparator producing a high level output signal when the voltage level at its first input terminal is higher than the voltage level at its second input terminal;

a second comparator having a first input terminal connected to receive a second reference voltage, and having a second input terminal connected to the additional conductor and through the resistor to said one of the logic power supply nodes, the second comparator producing a high level output signal when the voltage level at its first input terminal;

the second reference voltage being between the first reference voltage and the voltage at said one of the logic power supply nodes;

the signal produced by the temperature sensor having a level between the first and second reference voltages if the temperature is lower than the predetermined temperature, and being lower than the first reference voltage if the temperature is higher than the predetermined value; and AND means for receiving the output signals of said first and second comparators and producing a low level output signal if at least one of said first and second comparators outputs a low level signal, the output signal of the AND means being conveyed to the control unit.

14. The printer of claim 10, wherein the temperature sensor comprises a thermistor, and wherein the voltage within a certain region is a voltage of less than about 2½ volts.

15. The printer of claim 10, further comprising a connector electrically coupling the cable to the control unit.

16. The printer of claim 15, further comprising a connector electrically coupling the cable to the carriage section.

17. The printer of claim 10, further comprising a connector electrically coupling the cable to the carriage section.

18. The printer of claim 10, wherein the carriage section further comprises means, controlled by the control unit, for forming a current path to cause a current to flow through the drive power supply conductor to a drive coil when the switching element is closed, and for forming a current path to permit a current to flow through the discharge conductor from the respective drive coil after the switching element has been opened.

* * * * *